United States Patent [19]

Chao

[11] 4,404,477

[45] Sep. 13, 1983

[54] DETECTION CIRCUIT AND STRUCTURE THEREFOR

[75] Inventor: Robert L. Chao, Sunnyvale, Calif.

[73] Assignee: Supertex, Inc., Sunnyvale, Calif.

[21] Appl. No.: 93,157

[22] Filed: Nov. 13, 1979

Related U.S. Application Data

[62] Division of Ser. No. 880,035, Feb. 22, 1978, Pat. No. 4,215,281.

[51] Int. Cl.[3] ..... H03K 3/01; G05F 3/20

[52] U.S. Cl. ..... 307/297; 307/318; 323/314

[58] Field of Search ..... 307/296 R, 297, 318; 323/313, 314

[56] References Cited

U.S. PATENT DOCUMENTS

| | | | |
|---|---|---|---|
| 2,876,366 | 3/1959 | Hussey | 307/318 |
| 3,134,078 | 5/1964 | Holmes | 307/318 |
| 3,303,413 | 2/1967 | Warner, Jr. et al. | 307/318 |
| 3,508,084 | 4/1970 | Warner, Jr. | 307/304 |
| 3,823,332 | 7/1974 | Feryszka et al. | 307/297 |

*Primary Examiner*—John Zazworsky
*Attorney, Agent, or Firm*—Harry M. Weiss

[57] ABSTRACT

Improved circuitry for providing a stable reference voltage in complementary transistor circuitry. The circuitry comprises a pair of complementary transistors and a pair of zener diodes interconnected to reduce reference voltage variation with respect to supply voltages.

3 Claims, 1 Drawing Figure

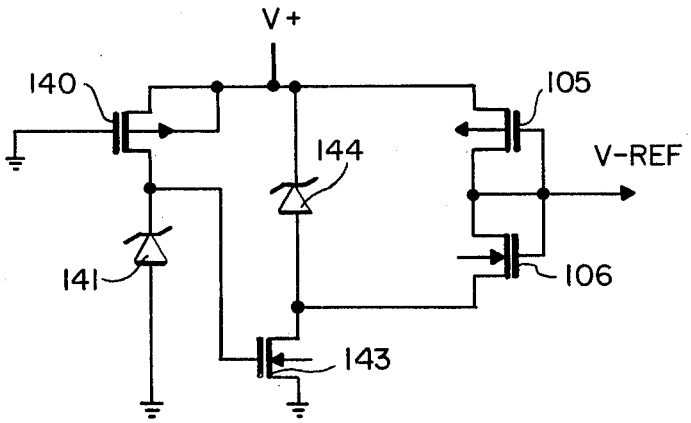
V+
140
105
144
V-REF
141
106
143

DETECTION CIRCUIT AND STRUCTURE THEREFOR

This is a division of application Ser. No. 880,035; filed Feb. 22, 1978; now U.S. Pat. No. 4,125,281, issued July 29, 1980.

FIELD OF THE INVENTION

This invention relates to improved reference voltage circuitry, and especially relates to reference voltage circuits comprising complementary transistors.

SUMMARY OF THE INVENTION

It is an object of the present invention to provide an improve reference voltage circuit comprising zener diodes and complementary transistors.

BRIEF DESCRIPTION OF THE DRAWING

The sole drawing is a detailed circuit diagram of a stable reference voltage circuit comprising two zener diodes and a pair of complementary transistors.

By reference to the FIGURE, which shows an improvement in a circuit for producing reference voltage signals, which may provide for example the operating potential for various current sources in an MOS system. The current of the FIGURE may be fully integrated as a part of a complementary transistor circuit along with the other circuit components. The circuit of the FIGURE essentially comprises a dual zener diode reference circuit which has improved stability over a single zener diode circuit.

The basic or first stage of the reference voltage is established by a P channel transistor device 140 connected in series with a zener diode 141 between the V+ supply and ground. The junction between these two devices is connected to the gate of an N channel device 143 of complementary polarity to P-channel device 140. The device 143 is connected in a series with a zener diode 144 between V+ and ground, with the zener diode 144 connected to the V+ terminal. This is in contrast to the arrangement used with the transistor 140 and zener diode 141, where the zener diode 141 is connected to the low potential or ground terminal.

The junction of the zener diode 144 and the N channel transistor 143 may be connected to one side of the reference voltage transistor set 105 and 106 to supply the reference voltage to a system as described in the parent application with reference to FIG. 3 of that application. If the division ratio which is provided by the devices 105 and 106 is not needed, then the junction between the zener diode 144 and the N channel transistor 143 could be used for the reference voltage instead of the arrangement shown in the Figure.

The voltage which is applied to the gate of the N channel device 143 is relatively constant even though fairly wide fluctuations in the current flowing through the P channel transistor 140 may take place in the leg of the circuit comprising the transistor 140 and the zener diode 141. By causing the relatively constant voltage to be applied to the gate of the complementary transistor device 143, however, it is changed to a substantially constant resistance element, so that the circuit in which it is connected with the zener diode 144 is much more stable with respect to variations in the value of V+ than if only a single zener diode circuit were employed. Thus, where a stable reference voltage, with its inherent advantages, is desired in a complementary transistor circuit, the circuit of the sole drawing may be used to provide such a stable reference voltage to other of the circuit elements as required, and as exemplified by the parent application.

Various modifications will occur to those skilled in the art which are equivalent to the circuits and structures, which have been described above in conjunction with the drawings for the preferred embodiments of the invention, without departing from the true scope of this invention; and the illustrations which have been used are therefore to be considered simply as that, merely illustrative of the invention and not as limiting.

What is claimed is:

1. A reference voltage circuit, comprising, in combination;

first and second voltage supply terminals;

a first zener diode and a first field effect transistor serially coupled, in the order recited, between said first and second voltage supply terminals;

a second field effect transistor and a second zener diode serially coupled, in the order recited, between said first and second voltage supply terminals, said second transistor being complementary to said first transistor and having a control electrode;

said control electrode being coupled to said first zener diode and said first transistor; and output means comprising third and fourth serially connected field effect transistors coupled to said second transistor and across said second zener diode for providing said reference voltage at a point between said third and fourth transistors.

2. The circuit of claim 1, where said first and second transistors are complementary MOS transistors.

3. The circuit of claim 2, where said first MOS transistor has a control electrode coupled to said first voltage supply terminal.

* * * * *